US005216215A

United States Patent [19]

Walker et al.

[11] Patent Number: 5,216,215

[45] Date of Patent: Jun. 1, 1993

[54] ELECTRICALLY POWERED FLUID HEATER INCLUDING A CORELESS TRANSFORMER AND AN ELECTRICALLY CONDUCTIVE JACKET

[75] Inventors: Ross J. H. Walker; Patrick S. Bodger, both of Christchurch, New Zealand

[73] Assignee: Transflux Holdings Limited, Christchurch, New Zealand

[21] Appl. No.: 703,295

[22] Filed: May 20, 1991

[30] Foreign Application Priority Data

May 29, 1990 [NZ] New Zealand ..... 233841

[51] Int. Cl.[5] ..... H05B 6/10

[52] U.S. Cl. ..... 219/10.51; 219/10.65; 219/10.75

[58] Field of Search ..... 219/10.51, 10.65, 10.491, 219/10.75, 10.79; 392/320, 481

[56] References Cited

U.S. PATENT DOCUMENTS

| | | | |
|---|---|---|---|
| 1,513,087 | 10/1924 | Buhl et al. | 219/10.51 |
| 1,656,518 | 1/1928 | Hammers | 219/10.51 |
| 1,918,637 | 7/1933 | Fendt et al. | 219/10.51 |
| 2,407,562 | 9/1946 | Lofgren | 219/10.51 |
| 3,867,563 | 2/1975 | Laflin | 219/10.77 |
| 4,471,191 | 9/1984 | Greis et al. | 219/10.51 |
| 4,602,140 | 7/1986 | Sobolewski | 219/10.51 |
| 4,791,262 | 12/1988 | Ando et al. | 219/10.51 |
| 4,855,552 | 8/1989 | Marceau et al. | 219/10.51 |

*Primary Examiner*—Philip H. Leung
*Attorney, Agent, or Firm*—Ross, Ross & Flavin

[57] ABSTRACT

A main-frequency electrically powered fluid heater which includes a coreless transformer and an electrically conductive jacket through which flows the fluid to be heated; the coreless transformer comprises a primary winding electrically insulated from the jacket but at least partially surrounding it, and a secondary winding arranged so as to be linked by magnetic flux from the primary winding; secondary winding being electrically insulated from the primary winding, but electrically connected to the jacket, so that the jacket is heated both by resistance heating and by eddy current heating.

11 Claims, 1 Drawing Sheet

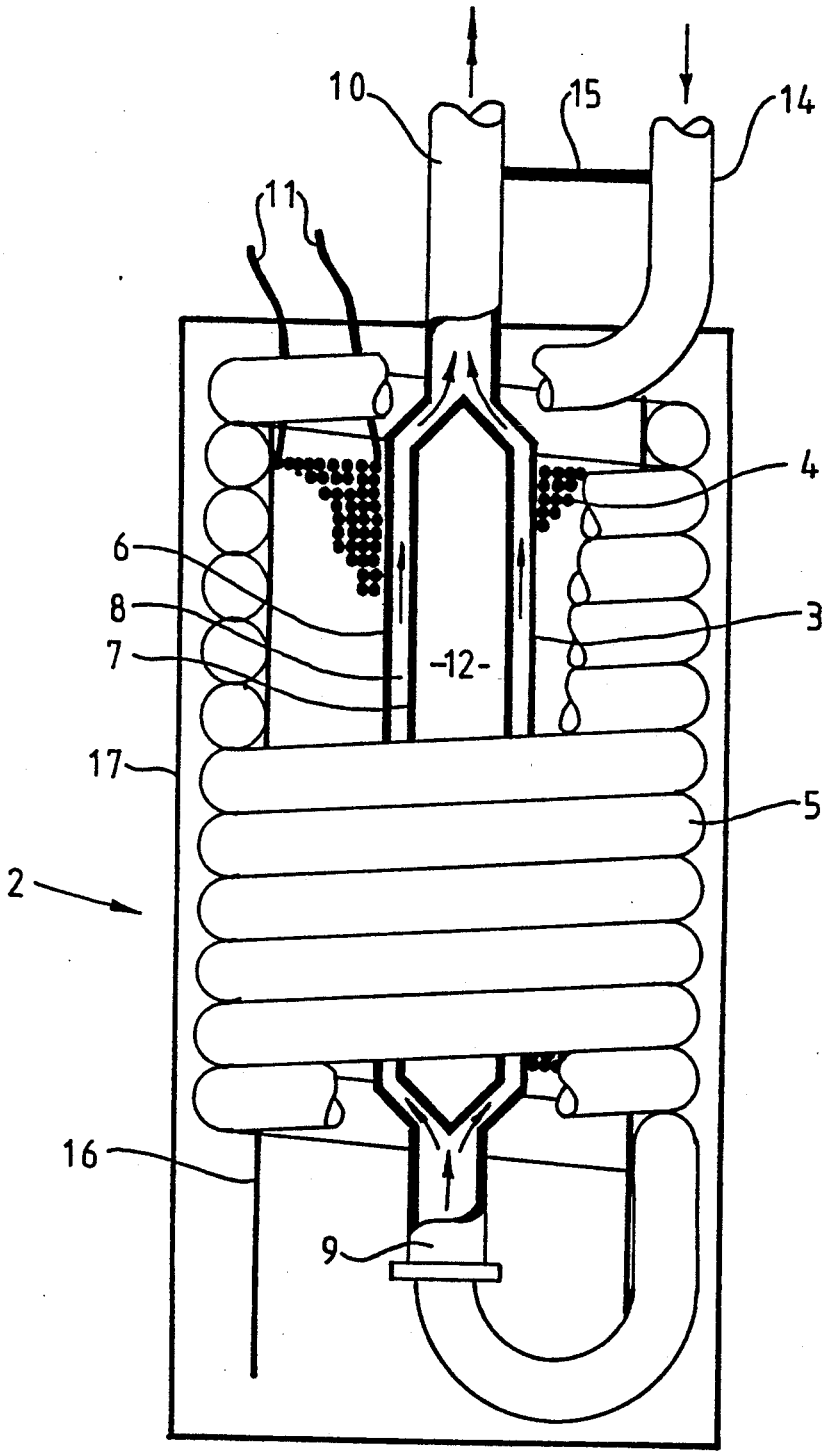
10
15
14
11
4
6
8
7
3
-12-
17
5
2
16
9

ELECTRICALLY POWERED FLUID HEATER INCLUDING A CORELESS TRANSFORMER AND AN ELECTRICALLY CONDUCTIVE JACKET

BACKGROUND OF THE INVENTION (1) Field of the Invention

The present invention relates to apparatus for heating a fluid, (i.e. liquid or gas) and in particular to apparatus capable of heating a continuous stream of fluid with high efficiency, without the use of exposed heating elements or open flames.

The apparatus of the present invention is especially useful for commercial—or industrial—scale water-heating, and will be described with particular reference to that application. However, it will be appreciated that the apparatus is by no means limited to this application, but also may be used to heat any of a wide range of fluids.

At present, commercial and industrial scale water-heating is generally a batch process: water held in a storage tank is heated by an electric heating element or by gas burners, and is held in the storage tank until required. This process has several drawbacks: the storage tank is bulky, and needs to be located near the place of use if heat losses in the delivery pipes are to be avoided; if the rate of use of hot water is low, a great deal of energy is consumed in holding a large volume of water at a high temperature needlessly; or if the rate of use of the water is high, the supply from the storage tank may be inadequate. To overcome these drawbacks, several designs of 'through-flow' water heaters have been marketed, but all such designs to date have been able to supply hot water only at relatively low flow-rates, and are expensive to install.

It is therefore an object of the present invention to provide a through flow (i.e. continuous) fluid heater which is relatively inexpensive to manufacture and install, but which is capable of operating efficiently at relatively high flow-rates.

In most commercial and domestic premises, mains electric power is available. It greatly reduces the expense of installing and operating electric fluid heaters if mains power can be used (i.e. an AC supply, with a frequency in the range 50–60 Hz) without the need to modify the type of supply or its frequency. It therefore is a further object of the invention to provide fluid heating apparatus capable of operating upon mains electric power.

(2) Description of the Prior Art

There have been many prior proposals to use an electric transformer to heat fluids, in particular, water.

For example, U.S. Pat. No. 1458634 (Alvin Waage, 1923) discloses a device consisting of a common core upon which primary and secondary coils are wound. The secondary coil is shorted, so that the induced voltage in the secondary causes a current to flow in the secondary coil, heating it. The secondary coil is tubular, and water to be heated is arranged to flow through it. The primary may also be tubular.

Heaters of this general type also are disclosed in U.S. Pat. Nos. 4602140 and 4791262.

A variant of this design is disclosed in U.S. Pat. No. 1656518, in which the fluid to be heated flows through a tank, which functions as a shorted secondary.

Another variant is disclosed in U.S. Pat. No. 2181274, in which the fluid to be heated flows through the core of the transformer; the primary and secondary coils are concentric about the core, the secondary coil effectively being a single shorted turn.

A further variant is disclosed in U.S. Pat. No. 1671839, in which the primary and secondary coils and the common core all may be hollow, and fluid to be heated is circulated through the core and (optionally) also through the primary and secondary coils. The secondary coil is shorted.

However, in all of the above-mentioned devices, the transformer has a core.

It is a well-established principle in electrical engineering practice that for mains-frequency devices, efficient magnetic flux linkage is achieved only if a transformer core is used. Coreless transformers have been known and used for many years, but only for high-frequency applications, (typically 50 kHz i.e. a thousand times greater than mains frequency) since in high-frequency applications, efficient flux linkage can be achieved without a core.

However, the design of the present invention has been found to possess an unexpected and surprising advantage, in that although the device of the present invention is coreless, it has been found to operate with very high efficiency at mains frequency.

Coreless transformers have a number of advantages over cored transformers: firstly, there is a significant cost saving because the core does not have to made or fitted. Secondly, coreless transformers typically exhibit a near-linear magnetization curve, in contrast to the plateaued magnetization curve exhibited by cored transformers. The near-linear magnetization curve means that the transformer can be operated efficiently over a much larger voltage range, and is therefore more controllable i.e. it is possible to vary the voltage over a much wider range without being effected by the plateau. A further advantage is that a coreless transformer is easier to cool simply because there is no core to offer impediment to cooling fluids; hence, the efficiency of the transformer is improved.

A further characteristic of all of the above-mentioned devices is that the fluid essentially is heated by a single method only i.e. by conduction from the shorted secondary. The secondary coil normally is made of low resistance material, because this is required for efficient power transfer. However, a low resistance material is not ideal for a resistance heating element, for which a high resistance material is preferable.

U.S. Pat. No. 4471191 discloses a fluid heating device which essentially incorporates a coreless transformer: a primary coil surrounds a container, the interior of which is subdivided by metallic cylinders, which create passages through which flows the fluid to be heated. Secondary coils in the form of metallic rings or helices are located within the container, spaced from the cylinders.

In use, the primary coil induces a voltage in the secondary coil or coils, which are shorted so that heat is generated therein by the induced current. The metallic cylinders also are inductively heated, and the heat from the secondary coil or coils and from the cylinders heats the fluid passing through the container.

However, in this design, energy is wasted: firstly, the primary is outside the container, and thus can contribute nothing to the heating of the fluid. Secondly, the concentric arrangement of the secondary coils and metallic cylinders means that the linkage of magnetic flux between primary and secondary coils is far from ideal, and flux leakage will occur, lowering the effectiveness of the device. Thirdly, the secondary coil or coils are shorted, rather than being connected to a ,load which is resistance-heated by the secondary voltage; this has the drawbacks discussed above.

It is therefor a further object of the present invention to provide a fluid heating device which overcomes at least the third of the above described disadvantages and which is capable of operating with high efficiency at mains frequency.

(3) Brief Summary of the Invention

The present invention provides a mains-frequency electrically powered fluid heater which includes a coreless transformer and an electrically conductive jacket through which fluid to be heated flows in use, said coreless transformer comprising: a primary winding of electrically conductive material, arranged to at least partially surround said jacket, but electrically insulated therefrom; a secondary winding of electrically conductive material arranged relative to the primary winding such that in use, magnetic flux generated by an alternating electrical current flowing in said primary winding links said secondary winding and induces a voltage therein; said secondary winding being electrically insulated from said primary winding, but electrically connected to the jacket such that in use said voltage induced in said secondary winding gives rise to a current flowing through said jacket which heats said jacket by resistance heating, said jacket also being heated by eddy currents induced therein by said alternating current flowing in said primary winding.

Preferably, said jacket, primary winding and secondary winding all are concentric, with the primary winding next to the jacket and the secondary winding around the exterior of the primary winding. However, an arrangement in which the primary winding was around the exterior of the secondary winding also would be possible.

Multiple secondary windings may be used, both or all of which are electrically connected to the jacket in series or in parallel.

The secondary winding may be tubular, (for example, a spiral or a double-walled jacket) the secondary winding being connected to the jacket such that fluid to be heated flows through the secondary winding either before or after flowing through the jacket. This pattern of fluid flow assists in cooling the secondary as well as heating the fluid. The primary may also be tubular, for the same purpose, but this has been found to be less desirable in that it presents practical design difficulties.

BRIEF DESCRIPTION OF THE DRAWING

By way of example only, a preferred embodiment of the present invention is described in detail with reference to the accompanying drawing which is a view, partly in longitudinal section, of apparatus in accordance with the invention

DETAILED DESCRIPTION OF THE PREFERRED EMBODIMENTS

Referring to the drawing, apparatus 2 comprises a double-skinned jacket 3 around which is wound a primary winding 4; a secondary winding 5 is wound over the primary winding 4.

The jacket 3 is made of metal, advantageously a metal which has a relatively high electrical resistance.

It must be emphasised that the jacket does not function as a transformer core, and there is therefore no need for the jacket to be made of a ferromagnetic metal. However, it is advantageous if the jacket is made of a ferromagnetic metal, since this improves the power factor of the device, by improving the magnetization of the device. One suitable material for the jacket is wrought iron, which fulfils all of the above criteria.

The jacket provides an outer wall 6 and an inner wall 7, with a cylindrical passage 8 between the walls through which fluid flows when the apparatus is in use. One end of the passage 8 is connected by a fluid-tight connection 9 to the interior of a coiled tube which forms the secondary winding 5, and the other end of the passage 8 is connected to an outlet pipe 10.

The space 12 within the inner wall 7 is air-filled; this space may house a metal core, but the use of such a core has not been found to significantly alter the performance of the apparatus.

Alternatively, the jacket could be single-walled, providing the fluid to be heated by the device was a good conductor of heat, or only a relatively low heating rate was required. The fluid in the jacket is heated by conduction from the heated walls, and therefore only the layers of fluid in contact with those walls are heated directly: the rest of the fluid is heated by conduction and convection within the fluid. Thus, the length and width of the passage 8 must be selected with regard to the type of fluid to be heated, the desired temperature rise in the fluid, and the desired rate of flow.

The primary winding 4 consists of turns of insulated wire wound directly onto the exterior of the jacket 3, the wire being arranged in one or more spaced-apart layers, as necessary to accommodate the length of the winding. The wire is of a material which is a good conductor of electricity (eg. copper, aluminium, superconductors). The ends 11 of the primary winding are connectable to an AC mains power supply (230 volts, 50 Hz).

The secondary winding 5 comprises a spiral of tube made of a material which is a good conductor of both heat and electricity (e.g. copper, aluminium).

The secondary winding is wound around an oil-flow baffle 16. The device is sealed within a thermally insulating tank 17. The primary winding 4 is cooled by oil pumped around the tank by a pump (not shown). The cooling oil is forced between the spaced layers of the primary winding, and then around the exterior surface of the secondary winding, transferring heat from the primary to the secondary winding, and hence to fluid circulating in the secondary winding.

However, if a simpler fluid-heating device is required, and a lower heat output is acceptable (i.e. the device may be operated at a lower temperature) then the tank 17 and the cooling oil may be omitted, and the primary winding cooled simply by winding the secondary tightly over the primary, so that the primary is cooled by conduction.

As mentioned above, one end of the secondary winding is connected by connection 9 to the passage 8 of the jacket 3; the other end of the secondary winding is connected to a fluid inlet 14. Both ends of the secondary winding are electrically connected to the jacket 3, by any suitable means e.g. the connection 9 (which is an electrical as well as a fluid connection) and a metal plug 15 (which is an electrical connection only).

The above-described device is used as follows: fluid to be heated (e.g. water) is fed into the tubular secondary winding through the inlet 14. The fluid travels along the length of the secondary winding, and at the other end is fed into the passage 8 of the jacket 3 through the connection 9. The fluid then travels along the length of the jacket 3 and is discharged from the outlet pipe 10. However, it is envisaged that a reverse fluid flow (i.e. through the passage 8 first, and then through the secondary winding) would be feasible.

The primary winding 4 is supplied with mains AC current (single—or multi-phase). This current produces a magnetic flux which induces an electric voltage in the secondary winding; this induced voltage gives rise to a current which passes through to the jacket 3 via electrical connections 9 & 15, and so heats the jacket by resistance heating. In other words, the jacket forms the load of the transformer circuit. It will be appreciated that the use for the jacket of a metal which has a relatively high resistance is advantageous, since this maximizes resistance heating and improves the power factor of the device.

If the jacket is metal, it also is heated by eddy currents created by the fluctuating magnetic field of the primary winding. This effect is marked in the arrangement shown in the drawing where the primary windings lie between the jacket and the secondary windings, but occurs to a lesser extent even if the secondary winding lies between the primary winding and the jacket. Further heating of the jacket occurs by hysteresis heating from hysteresis loss.

The primary and secondary windings also tend to heat during use: this heating occurs because of the resistance of the metal of the windings to the currents flowing through the windings. In accordance with established transformer practice, using metals of good electrical conductivity for the primary and secondary windings will minimize this resistance heating. Also, the design of the device and/or the cooling system used (as discussed earlier) must be selected so as to keep the primary winding within a suitable operating temperature range.

In the case of the secondary winding, however, if a tubular secondary winding is used, then the fluid to be heated circulating therethrough cools the secondary, and it is believed that it may be advantageous to select a relatively high-resistance metal (e.g. steel) for the secondary winding since the heat developed in the secondary winding can be usefully employed in heating the fluid.

When the fluid enters the jacket, the fluid is heated further, by conduction from the jacket. Since heating of the fluid in the jacket is by conduction, the passage 8 preferably is relatively narrow, to obtain maximum contact between the fluid and the jacket.

It will be appreciated that in the above-described embodiment, the device supplies heat to the fluid in a number of separate ways:

1. By resistance heating of the jacket.
2. By eddy-current and hysteresis heating of the jacket.
3. By resistance heating of the primary winding, transferred to the secondary winding by the primary winding cooling system.
4. By resistance heating of the secondary winding.

It will be appreciated that the fluid could be heated by passing it only through the jacket, and not the secondary winding, although this could be disadvantageous in that the secondary winding would not be cooled, and the fluid would not be heated by conduction from the secondary winding.

In an alternative to the above-described design, the jacket 3 is in the form of a spiral of tubing through which flows the water to be heated.

A test was conducted upon apparatus constructed as shown in the drawing. The jacket 3 was made of wrought iron, and was 265 mm long, with an extended diameter of 60 mm and a passage 8 approximately 3 mm in diameter.

The primary winding was made of 327 turns of 3.75 mm diameter copper wire. The secondary winding was 13 turns of a copper tube of 11.5 mm diameter.

The primary winding was connected to a mains power supply:

Voltage 230 V
Temperature of
Frequency 50 Hz
primary winding: 105°-93° C.
Current 147.5 A
Efficiency 96%
Power 29.7 kw
Power factor 0.874 lag The device operated in a steady-state electrically, and was thermally stable. Water at an inlet temperature of 15 degrees Celsius was passed through the device at a rate of approximately 17.9 l/min, passing through the secondary and then through the jacket, and leaving the outlet at 38 degrees Celsius.

As all the heat generated by the device is transferred to the water (less electrical lead, conduction and tank radiation losses) the device efficiency is >95%.

For commercial or industrial use, the above-described apparatus would be fitted with controls which enabled the fluid output temperature to be preselected or varied as required, together with a pressure sensor or flow-rate detector which started the power supply to the apparatus when fluid flow started, and stopped it when fluid flow stopped or fell below a safe minimum value.

The apparatus can be designed to operate at high pressures, and can be used to produce steam e.g. as a replacement for steam boilers.

Devices have been designed to operate at 230 V and 400 V, with power outputs in the range 6 KW–40 KW, but could be designed to operate outside these ranges.

We claim:

1. A mains-frequency electrically powered fluid heater characterised in that said heater includes a coreless transformer and an electrically conductive jacket through which fluid to be heated flows in use; said coreless transformer comprising: a primary winding of electrically conductive material, arranged to at least partially surround said jacket, but electrically insulated therefrom; a secondary winding of electrically conductive material arranged relative to the primary winding such that magnetic flux generated by an alternating electrical current flowing in said primary winding in use links said secondary winding and induces a voltage therein; said secondary winding being electrically insulated from said primary winding, but electrically connected to the jacket such that said voltage induced in said secondary winding in use gives rise to a current flowing through said jacket which heats said jacket by resistance heating, said jacket also being heated by eddy currents induced therein by the primary winding.

2. The heater as claimed in claim 1 wherein the secondary winding is formed in two or more parts, each of which is electrically connected to the jacket.

3. The heater as claimed in claim 1 wherein the secondary winding is tubular, and is connected to the jacket such that fluid to be heated flows through the secondary winding before or after flowing through the jacket, thereby heating said fluid by transformer heating.

4. The heater as claimed in claim 1 wherein said jacket, primary winding and secondary winding all are concentric.

5. The heater as claimed in claim 3 wherein said jacket, primary winding and secondary winding all are concentric.

6. The heater as claimed in claim 4 or claim 5 wherein the jacket is at least partially surrounded by the primary winding which is at least partially surrounded by the secondary winding.

7. A mains-frequency electrically powered fluid heater which includes a coreless transformer and a jacket of high-resistance electrically conductive material, through which fluid to be heated flows in use; said coreless transformer comprising: a primary winding of low-resistance electrically conductive material, wound around a major part of the length of the jacket, but electrically insulated therefrom; a tubular secondary winding of low-resistance electrically conductive material wound around the primary winding, said secondary winding being electrically insulated from said primary winding but electrically connected to the jacket such that the voltage induced in use in the secondary winding by a current flowing in the primary winding gives rise to a current flowing through said jacket which heats said jacket by resistance heating, said jacket also being heated by eddy current induced therein by the primary winding; fluid to be heated being arranged to flow through said secondary winding before or after flowing through said jacket.

8. The heater as claimed in claim 7 wherein the jacket is double-skinned and fluid to be heated flows between said skins.

9. The heater as claimed in claim 7 or claim 8 wherein the primary winding is cooled in use by forced oil circulation, said oil also being circulated over said secondary winding, to transfer heat from said primary winding to said secondary winding.

10. The heater as claimed in claim 7 or claim 8 wherein the secondary winding is in physical contact with, but electrically insulated from, the outer layer of the primary winding, such that in use the primary winding is cooled by conduction to the secondary winding.

11. The heater as claimed in claim 7 wherein the primary and secondary windings are made of copper, and the jacket is made of wrought iron.

* * * * *